US007021359B2

(12) United States Patent
Yu et al.

(10) Patent No.: US 7,021,359 B2
(45) Date of Patent: Apr. 4, 2006

(54) WINDOW COVERING

(75) Inventors: Fu-Lai Yu, Taipei Hsieh (TW); Chin-Tien Huang, Taipei Hsieh (TW); Shun-Chi Yu, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 0 days.

(21) Appl. No.: 10/914,582

(22) Filed: Aug. 9, 2004

(65) Prior Publication Data

US 2005/0006033 A1 Jan. 13, 2005

Related U.S. Application Data

(63) Continuation-in-part of application No. 10/427,829, filed on May 1, 2003, now Pat. No. 6,932,138, and a continuation-in-part of application No. 10/413,200, filed on Apr. 14, 2003, now Pat. No. 6,792,996.

(51) Int. Cl.
*E06B 9/384* (2006.01)

(52) U.S. Cl. ..... 160/84.04; 160/176.1 R

(58) Field of Classification Search ..... 160/84.03, 160/84.04, 84.05, 180, 168.1 R, 178.3, 80, 160/116, 89
See application file for complete search history.

(56) References Cited

U.S. PATENT DOCUMENTS

| | | | | |
|---|---|---|---|---|
| 2,267,869 | A | 12/1941 | Loehr | 160/89 |
| 4,951,729 | A | 8/1990 | Chi Yu | 160/178.3 |
| 5,165,459 | A | 11/1992 | Gaber et al. | 160/168.1 R |
| 5,375,642 | A | 12/1994 | Gaber et al. | 160/168.1 R |
| 5,409,050 | A | 4/1995 | Hong | 160/168.1 R |
| 5,582,226 | A | 12/1996 | Voss et al. | 160/168.1 R |
| 5,680,891 | A * | 10/1997 | Prince | 160/84.05 |
| 5,733,632 | A * | 3/1998 | Marusak | 428/181 |
| 5,787,951 | A * | 8/1998 | Tonomura et al. | 160/84.01 |
| 5,845,690 | A | 12/1998 | Colson et al. | 160/84.01 |
| 5,918,655 | A * | 7/1999 | Corey | 160/84.05 |
| 6,006,812 | A * | 12/1999 | Corey | 160/84.05 |
| 6,029,734 | A | 2/2000 | Wang et al. | 160/170 |
| 6,354,353 | B1 | 3/2002 | Green et al. | 160/84.04 |
| 2003/0127196 | A1 | 7/2003 | Corey et al. | 160/84.05 |
| 2003/0188835 | A1 | 10/2003 | Corey et al. | 160/84.05 |
| 2005/0155722 | A1 * | 7/2005 | Colson et al. | 160/89 |

FOREIGN PATENT DOCUMENTS

DE 28 44 891 A1 4/1980

* cited by examiner

*Primary Examiner*—Blair M. Johnson
(74) *Attorney, Agent, or Firm*—Olson & Hierl, Ltd.

(57) ABSTRACT

A window shade comprising a plurality of collapsible shade rows. Each of the shade rows being adjustable from a closed state to an opened state by an operating mechanism, and including a stiff first transverse region and an opposed second transverse region having a stiffened edge portion. When in the closed state, the window covering includes no or minimal gaps between the rows so that light is substantially or completely blocked. Also, the securement and opening members are also concealed from view when observed from the front or face of the window covering. The operating mechanism causes the narrowing of the rows by drawing the first transverse region and the opposed second transverse region closer together. The operating mechanism further causes the rows to be pivotally rotated to further widen opening in the window covering.

50 Claims, 11 Drawing Sheets

WINDOW COVERING

RELATED APPLICATION

This application is a continuation-in-part of application Ser. No. 10/427,829, which was filed on May 1, 2003 now U.S. Pat. No. 6,932,138, and application Ser. No. 10/413,200, which was filed on Apr. 14, 2003 now U.S. Pat. No. 6,792,996.

TECHNICAL FIELD OF THE INVENTION

This invention relates to an improved window covering. More particularly, this invention relates to a window covering comprising a plurality of rows and an operating mechanism, wherein the rows are capable of being adjusted from a closed state to an opened state by both narrowing and pivoting the rows.

BACKGROUND OF THE INVENTION

Decorative window coverings are a popular item for providing privacy and blocking light, which take on various forms. Two popular examples of window coverings are Roman shades and Venetian blinds.

A typical Roman shade consists of a fabric material attached along its top edge to a head rail and gathered at spaced intervals to provide a series of soft folds across the face of the fabric, which give it a cascaded or softly pleated appearance. Roman shades are constructed so that when they are raised, they gather from the bottom in generally horizontal folds or pleats until the entire shade resides near the top of the window covering. The shades are operated by pulling on various lines which are used in conjunction with guides attached to the shade.

One drawback to the typical Roman shade, however, is that there is no way to create openings in the overall face of the window covering if one wishes to permit light into a room, such as found in Venetian blinds by tilting the blind slats, without having to raise the bottom, or lower the top of the entire window covering, which undesirably results in a substantial loss of privacy. Therefore, it is desired to provide the ability to open gaps in the shade to allow light to pass, yet maintain a relatively high degree of privacy by not requiring the entire shade to be raised or lowered.

A conventional Venetian blind typically includes a head rail, a bottom rail, a plurality of slats, a raising mechanism including multiple raising cords, and a tilting or adjustment mechanism including multiple ladder strings. The lifting member typically comprises cords that are laterally symmetrically provided on the blind to balance the bottom rail and the slats for them to be lowered or lifted synchronously. By pulling the raising cords, the bottom rail and the slats are lifted or lowered relative to the head rail as desired.

The slats can be tilted upward or downward through operation of the tilting mechanism which adjusts the ladder strings. In this regard, each ladder generally includes a front and rear, and vertically-extending members or strings connected to each other by a plurality of vertically-spaced cross-rungs. Supported on each cross-rung, between the vertically-extending members of its ladder, is one length-wise side of a slat. The head rail generally includes this tilting or adjusting mechanism for moving the ladders, so that the vertically-extending members of each ladder move in opposite vertical directions relative to one another, to pivot each slat about its length-wise axis. By tilting the above-mentioned slats to a different angle of inclination, the amount and direction of light projected into a room through the Venetian blind can be controlled and adjusted.

Venetian blinds, however, have the aesthetic drawback that the ladder is partially visible from both the face and back of the blind when closed. This ladder undesirably disrupts the otherwise continuous appearance of the window covering. Also, holes for the raising and tilting cords may also be visible when the Venetian blind is closed. This again detracts from the aesthetic appeal of the window covering, as well as permits additional light to penetrate a room even when the blind slats are closed.

SUMMARY OF THE INVENTION

The present invention overcomes these shortcomings by providing an improved window covering, which enables gaps to be formed in the window covering, such as with a Venetian blind, yet also conceals the operating mechanism. The present invention further relates to a method for operating the window covering.

The window shade, according to the present invention includes a plurality of collapsible shade rows. Each of these shade rows is adjustable from a closed state to an opened state by an operating mechanism, and includes a stiff first transverse region and an opposed second transverse region having a stiffened edge portion. The second transverse region may be comprised of a flexible material, such as fabric, or may include a stiff material, such as found in the first transverse region. The transverse regions may be stiffened in any number of ways including, incorporating a stiffened member, such as a lightweight plastic slat, using a stiffened fabric, spray coating fabric, or the like.

In a preferred embodiment, the operating mechanism includes an opening member secured with the stiffened edge portion of the second transverse region, and a securement member secured with the first transverse region. The opening member can be a cord, a strip of material, or the like. Similarly, the securement member can be a cord, a strip of material, a panel extending across the rear of the window covering, or the like.

When in the closed state, the window covering includes no or minimal gaps between the rows so that light is substantially or completely blocked. Also, the securement and opening members are preferably concealed from view when observed from the front or face of the window covering. In the open state, the window covering preferably has the appearance of a Venetian blind whose plurality of slats are adjusted to a fully open position. In other words, each of the rows, when in the open state, preferably has a substantially flat profile and is aligned perpendicular to the length of the blind. Between the closed state and the open state, the window covering has a semi-opened state.

Adjustment of the window covering from the closed state to the semi-opened state is performed by narrowing the plurality of shade rows. Preferably, this includes decreasing the distance between the first transverse region and the stiffened edge portion of the plurality of rows. For example, when the opening member is secured to the lower edge of the plurality of shade rows, when the opening member is raised, the lower edge of each row is also raised relative to the upper edge, to which the securement member is secured, and drawn up behind the front of the row such that openings created in the face of the window covering permit light to pass. Alternatively, the opening member may be secured to the upper edge of each row and the securement member secured to the lower edge, such that as the opening member is lowered relative to the securement member, the rows are narrowed. In addition to being able to move the opening member relative to the securement member, it may also possible to move the securement member, while keeping the opening member stationary, or move both the securement member and the opening member either simultaneously or independently of one another. The plurality of rows may be narrowed by any of these methods until they are positioned in the semi-opened state where the stiffened edge portion of the second transverse region is adjacent to and preferably contacts the stiff first transverse region.

Adjustment of the plurality of rows from the semi-opened state to the opened state is accomplished by pivoting each of the plurality of shade rows by moving the stiffened edge portion relative to the first edge of the first transverse region. In a preferred form, the first stiff transverse regions of the shade rows are operatively connected with a weight to bias each of the shade rows toward the open position.

The present invention provides a very adaptable window covering that enables a user to narrow the rows of the window covering that has the appearance of a Roman style shade, while also enabling the user to tilt the various rows to fully open the window covering. In some embodiments, the present invention also gives a user the ability to select the particular rows of the window covering to be opened or closed.

DESCRIPTION OF THE PREFERRED EMBODIMENTS OF THE INVENTION

Figure 1:
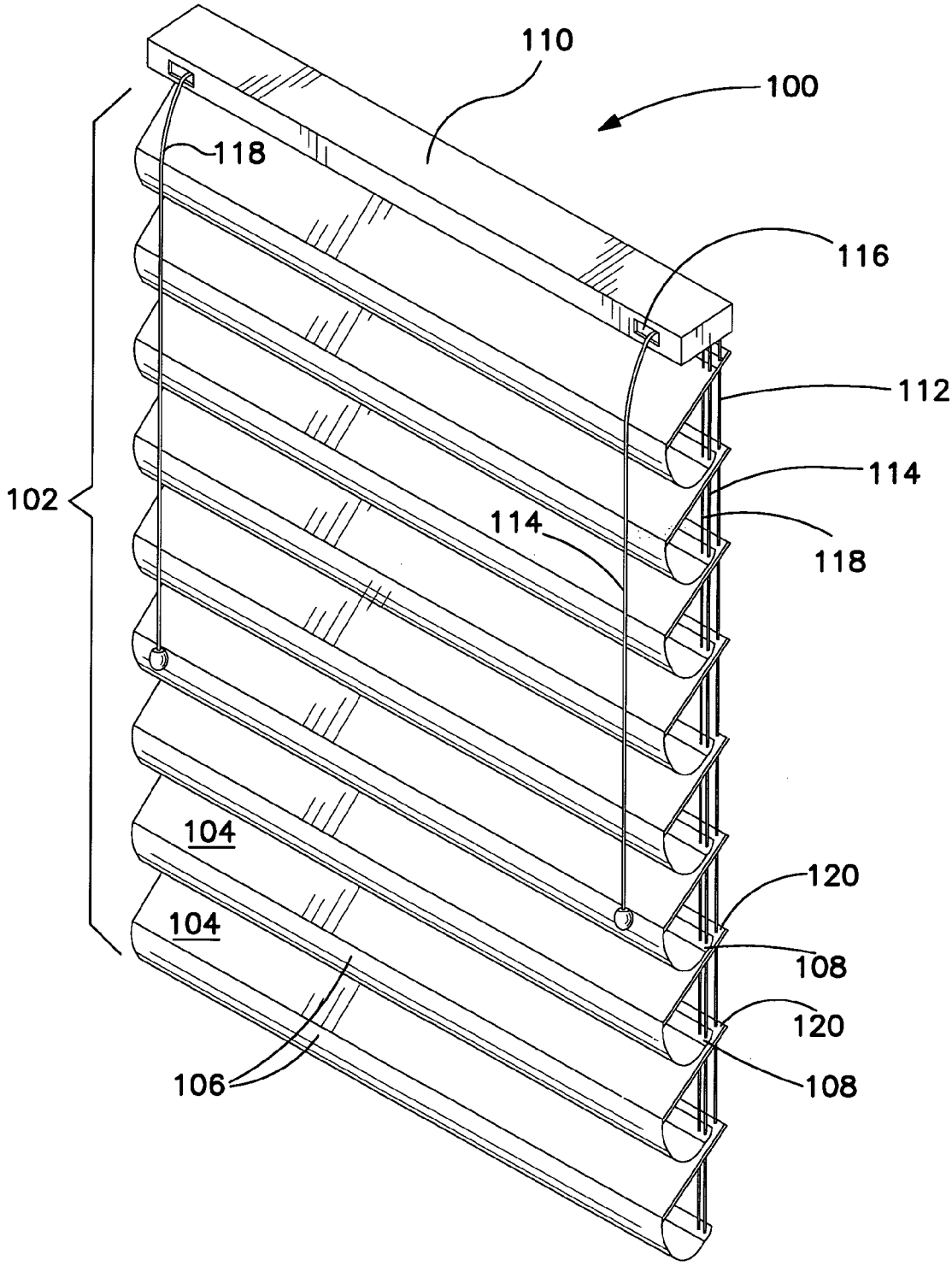
FIG. 1 is a perspective front view of a preferred embodiment of a window covering in a closed position according to the present invention.

The invention disclosed herein is susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Figure 2:
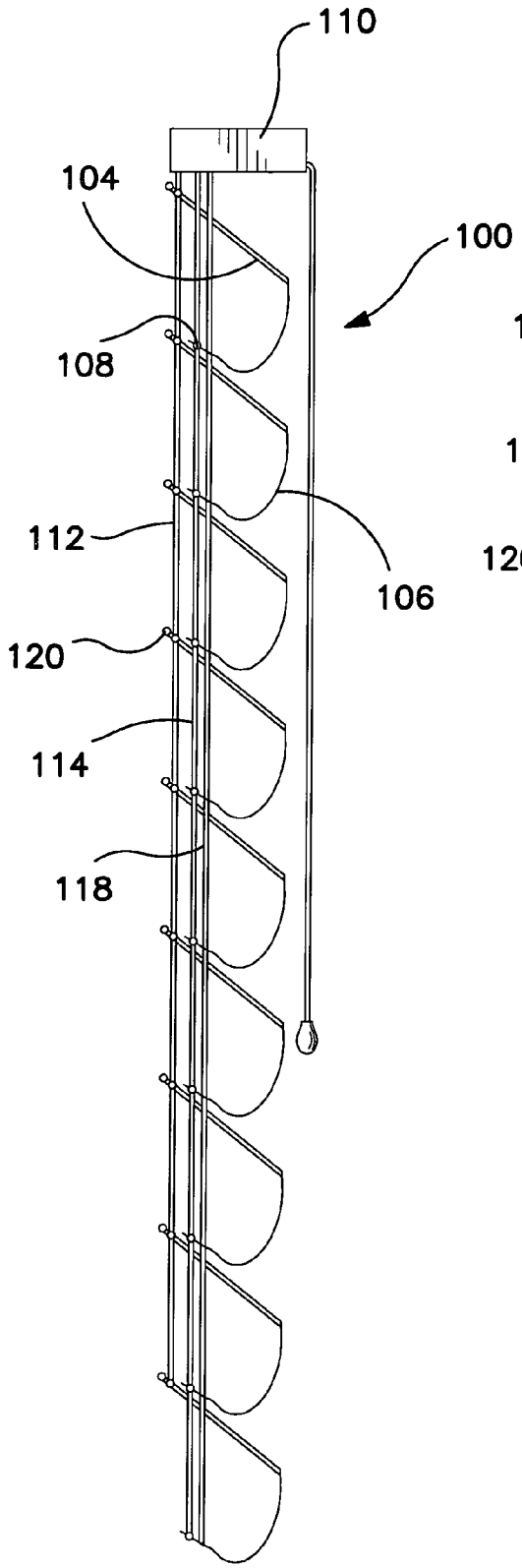
FIG. 2 is an elevated side view of the window covering of FIG. 1.

Referring to FIGS. 1 and 2, one preferred embodiment of the window covering of the present invention is shown in a closed position. The window covering 100 includes a plurality of collapsible shade rows 102, each of which are adjustable from a closed state to an opened state by an operating mechanism. Each of the shade rows 102 includes a stiff first transverse region 104 and an opposed second transverse region 106 having a stiffened edge portion 108.

The plurality of rows 102 are suspended from a head row 110 by an operating mechanism, for example by a securement member 112 and an opening member 114. The securement member 112 is secured to the rear or first edge 120 of the first transverse region 104 of each of the plurality of rows 102. The opening member 114 is secured to the stiffened edge portion 108 of the opposed second transverse region 106 of each of the plurality of rows 102. The particular method for securing the securement member 112 and the opening member 114 to the rows can take many forms, such as by way of adhesive, ultra-sonic welding, knitting, tying, or the like. Securement can also be achieved by restricting the movement of the row portions relative to the securement member and opening member by stop mechanisms positioned on the securement and adjustment members. Yet another alternative is to incorporate an anchor in the rows, such as a rod, to which the securement member and opening member are tied. Such a rod may also be guided through holes defined by the securement and opening members to provide securement thereto.

In this embodiment the operating mechanism also includes a cord lock 116 in the head rail through which opening member 114 is guided. Actuation of the operating mechanism is accomplished by a user releasing the cord lock, raising or lowering the opening member 114 as desired, and engaging the cord lock 116. The operating mechanism may alternatively comprise any suitable mechanism for controllably raising and lowering the opening member such as a commonly found in Venetian blinds and Roman shades. A raise cord 118 may also be included to lift all of the rows 102 of the window shade 100.

As shown, when in the closed state, the window covering includes no or minimal gaps so that light is substantially or completely blocked. In particular the stiffened edge portion 108 is positioned below the first edge 120 of the first transverse region 104 of a lower adjacent row. Accordingly, the securement member 112 and opening members 114 are also concealed from view when observed from the front or face of the window covering.

Figure 3:
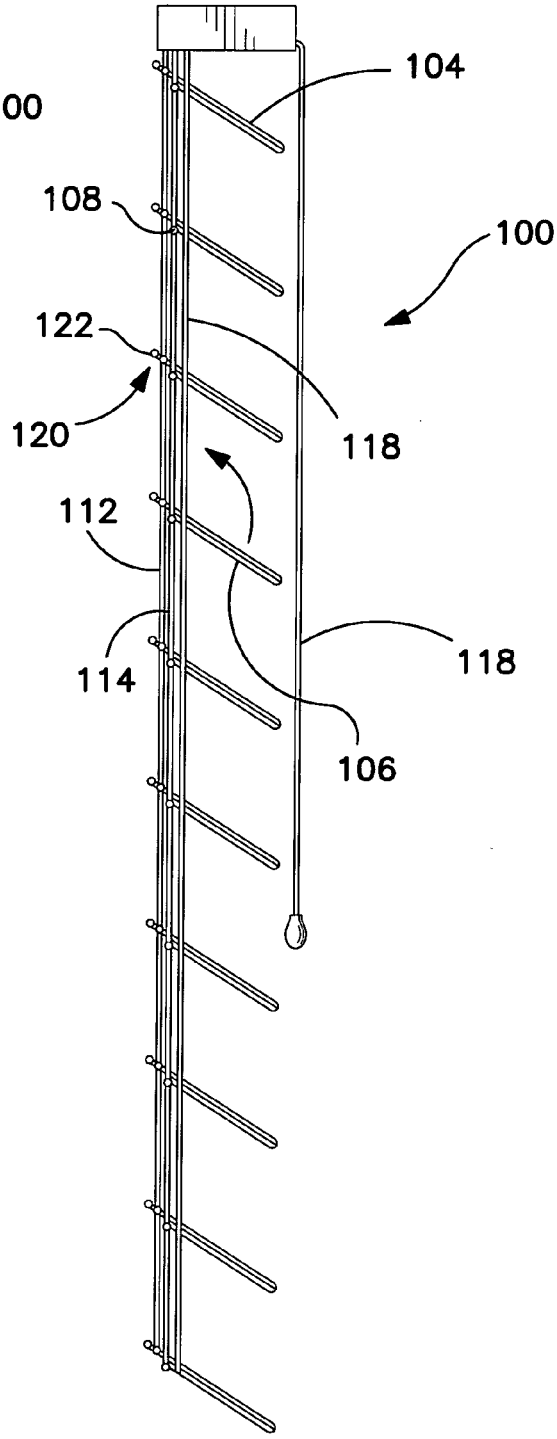
FIG. 3 is an elevated side view of the window covering of FIG. 1 in a semi-opened state.

Referring to FIG. 3, adjustment of the window covering 100 from the closed state to the semi-opened state is performed by narrowing the profile of each of the plurality of shade rows 102. Preferably, this includes decreasing the distance or narrowing the interstice between the first transverse region 104 and the stiffened edge portion 108 of the plurality of rows 102.

For example, when opening member 114 is raised, for each of the rows 102, the stiffened edge portion 108 is also raised relative to the first transverse region 104, and is drawn up behind the front of the row such that openings created in the face of the window covering 100 allow the passage of light. As shown, the window covering 100 is in a semi-opened state when the stiffened edge portion 108 of the second transverse region 106 contacts the stiff first transverse region 104. In the semi-opened state, each of the rows is tilted downward.

Figure 4:
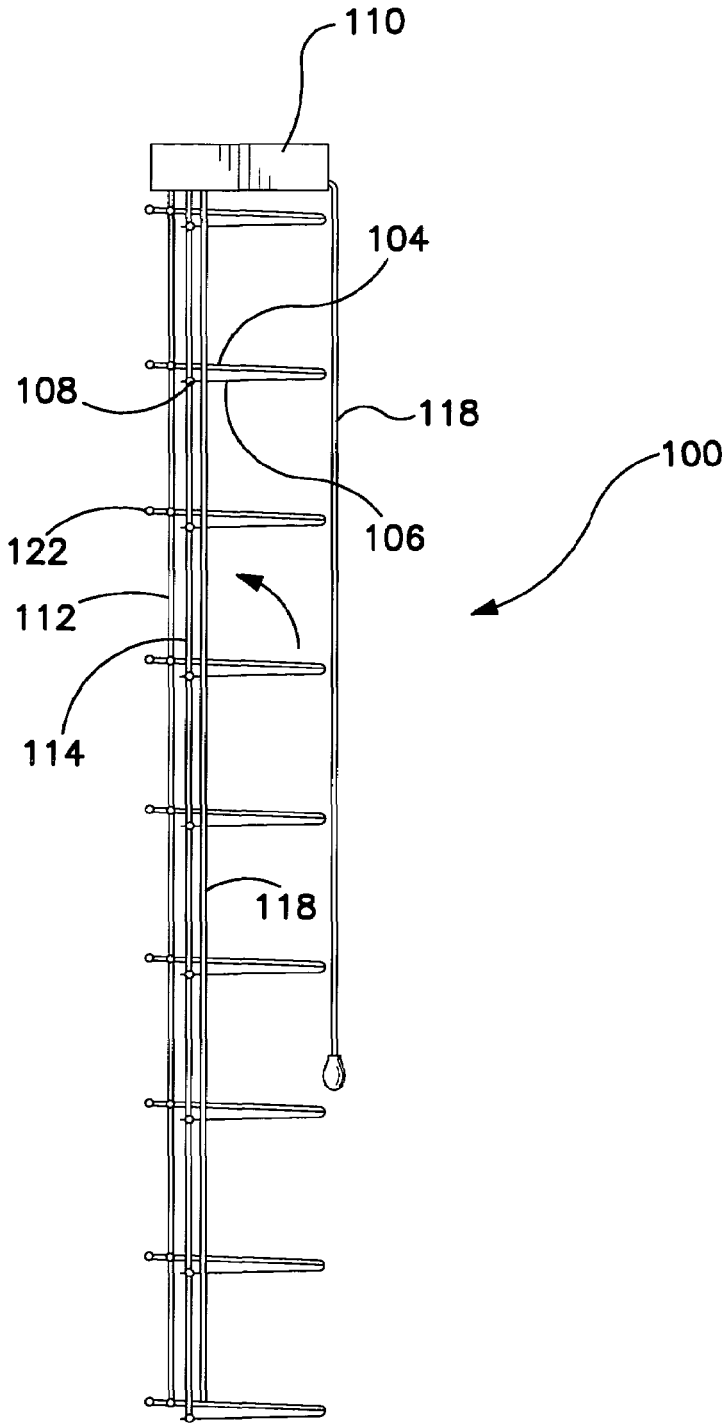
FIG. 4 is an elevated side view of the window covering of FIG. 1 in an opened state.

Referring to FIG. 4, adjustment of the plurality of rows from the semi-opened state to the opened state is accomplished by pivoting each of the plurality of shade rows 102 about the first edge 120 of the first transverse region by raising the stiffened edge portion 108 relative thereto. In a preferred form, the first stiff transverse regions 104 of the shade rows 102 are operatively connected with a weight 122 to assist each of the shade rows to pivot and rotate to the opened state.

Figure 5:
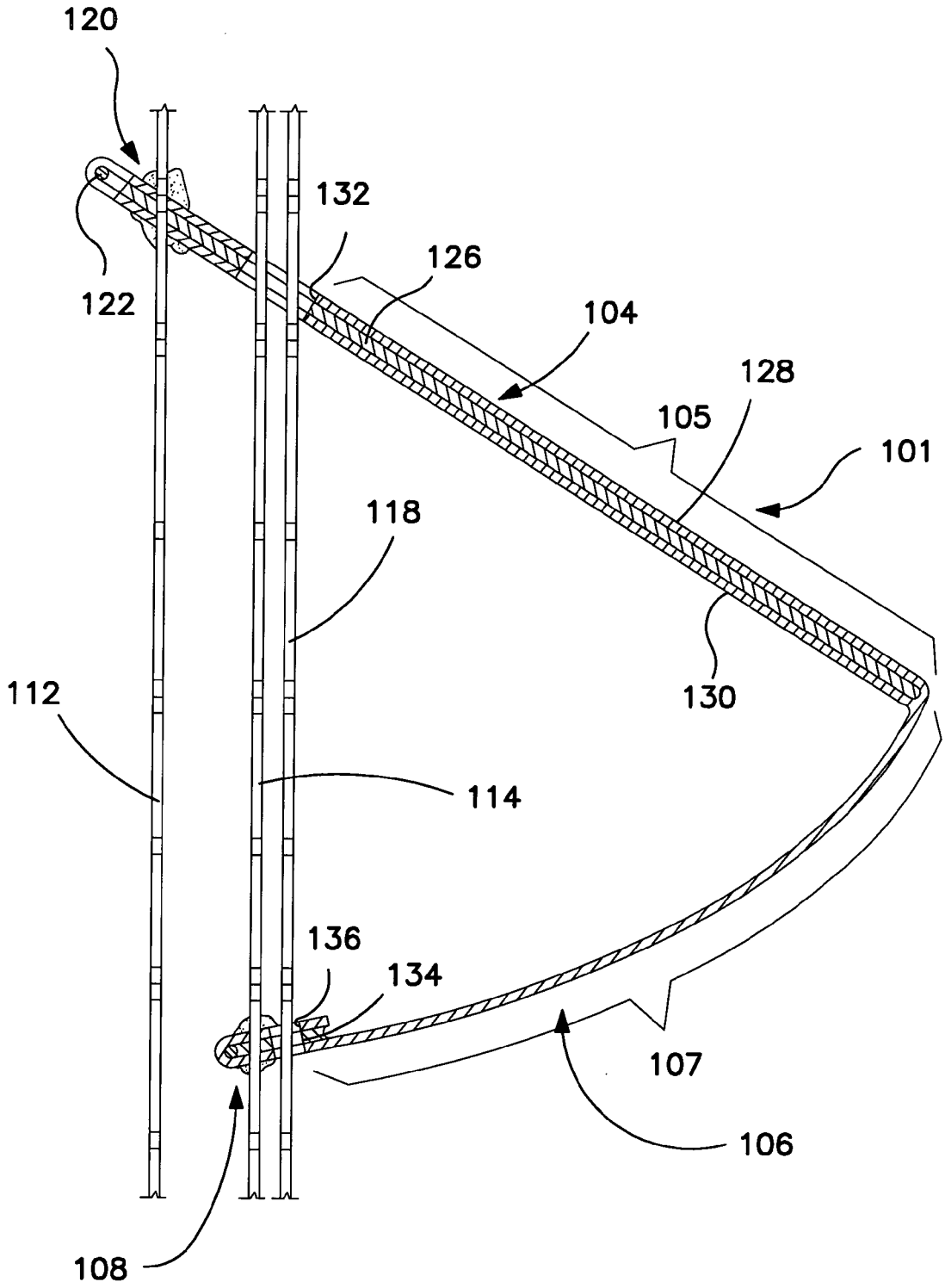
FIG. 5 is an enlarged cross sectional side view of a preferred row of an embodiment of a window covering in a closed state.

A more detailed explanation of each of the rows of the window covering 100 are discussed with respect to FIG. 5 and exemplary row 101. Row 101 is made from a fabric material having opposed transverse regions 104 and 106. Each of the transverse regions 104 and 106 include a distal portion 105 and 107, respectively. In this embodiment, first transverse region 104 includes a stiffening member, such as rigid slat 126, which is sandwiched between fabric layers 128 and 130. The first transverse region 104 further defines a hole 132. Also positioned with the first edge 120 of the first transverse region 104 is weight 122. Securement member 112 is secured to the first edge 120, whereas opening member 114 and raise cord 118 are passed through hole 132, and therefore not secured to the first transverse region 104. Weight 122, in this embodiment, is incorporated in the first edge 120, such as by including a rod of heavier material therein. Alternatively, a weight can be clipped or otherwise affixed about the first edge. As yet another alternative, the weight can be in the form of a bottom rail, which is operatively connected to each of the rows.

In this embodiment, the second transverse region 106 is formed of a flexible material such as fabric. Second transverse region 106 also includes a stiffened edge portion 108 having a strip member 134 and defining a hole 136, through which raise cord 118 is passed. Opening member 114 is secured to this stiffened edge portion 108. The securement member 112 passes rearward of the second transverse region 106. While it is described that the raising member 118 is positioned distally of the opening member, this is not required. Raising member 118 is also shown passing through hole 136. This is preferred, but not required. By passing raising member 118 through hole 136, it provides a guide for the plurality of rows and a generally more stable window covering.

In this embodiment, it is desired for the rows of the window covering, when opened, to have a substantially flat profile. As such, the distal portion 107 of the second transverse region 106 and the distal portion 105 of the first transverse region 104 are of substantially the same length. As will be explained in further detail below, since distal portion 105 and distal portion 107 are of substantially the same length, when the rows are opened, the first and second transverse portions 104, 106 will be adjacent to one another and have a generally flat profile. The window covering can alternatively be configured such that the second or lower distal portion is of a greater length than the first or upper distal portion such as to include a curved appearance.

Figure 6:
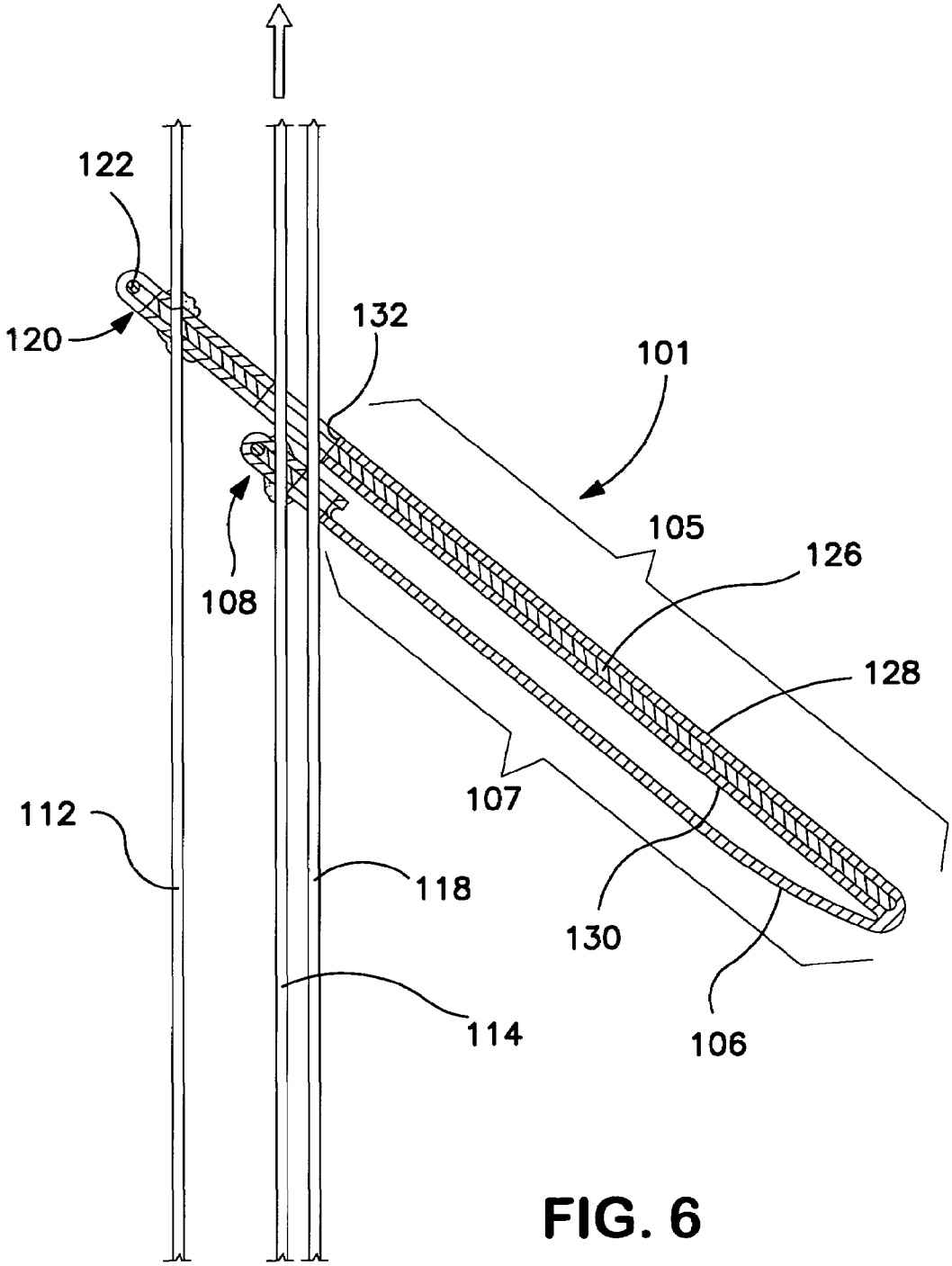
FIG. 6 is an enlarged cross sectional side view of the row of FIG. 5 in a semi-opened state.

As shown in FIG. 6, as the opening member 114 is raised, a second distal portion 107 of the second transverse region 106 is drawn up behind a first distal portion 105 of the first transverse region 104, thereby narrowing the profile of the row 101 and creating a gap. When the stiffened edge portion 108 of the second transverse region 106 contacts the first transverse region 104, the semi-opened state is reached. As shown in this embodiment, when the semi-opened state is reached, the distal portions 105 and 107 of first and second transverse regions 104 and 106, respectively, lie adjacent to one another.

Figure 7:
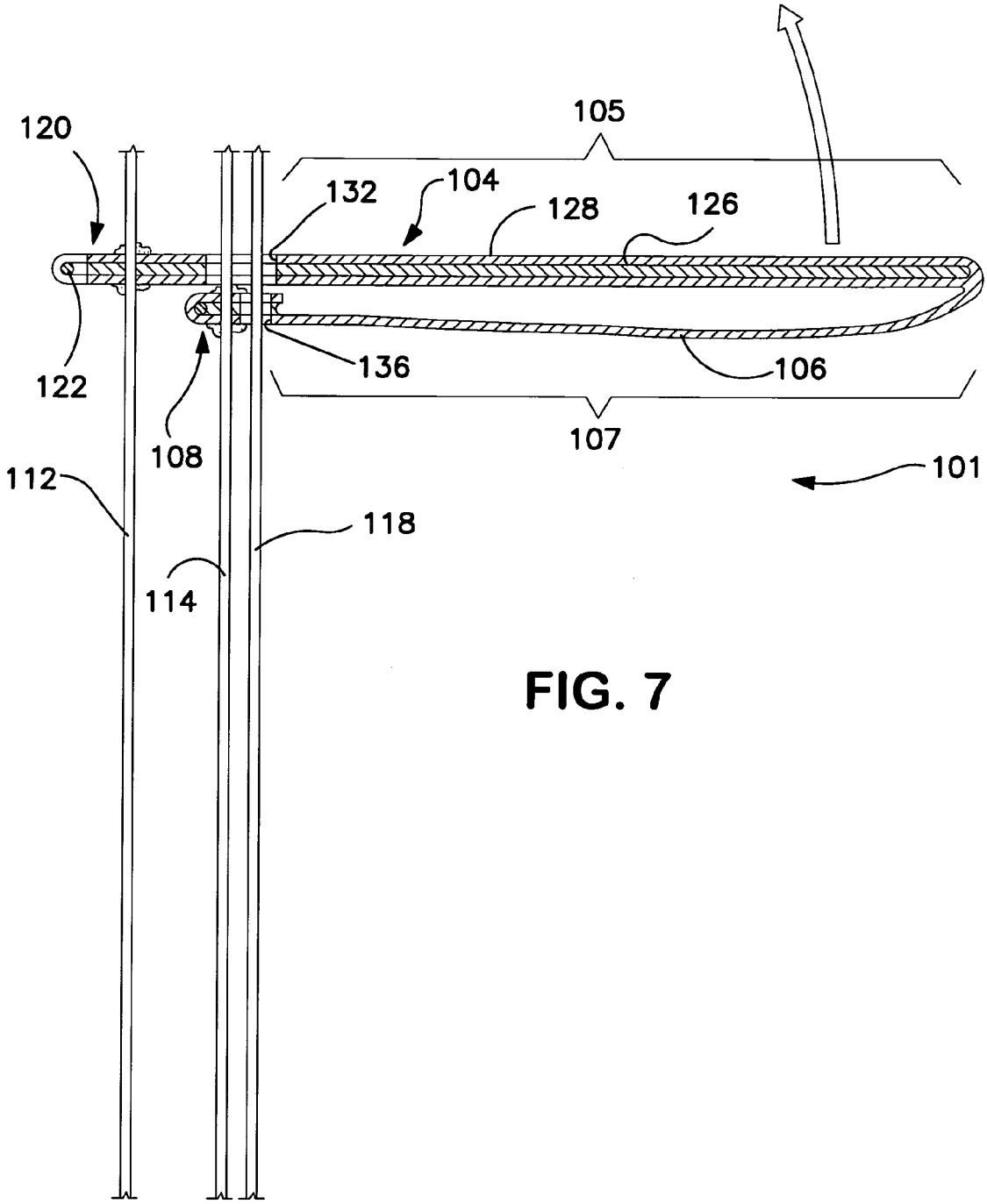
FIG. 7 is an enlarged cross sectional side view of the row of FIG. 5 in an opened state.

Referring to FIG. 7, as the opening member 114 is raised even further, the first transverse region 104 is pivoted or rotated substantially about the first edge 120. As shown, distal 105 portion of the first transverse region 104 rotates upwards, similar in effect to the tilting of the slats of a Venetian blind, however, done in a different way. Rather than utilize a ladder to tilt the slats, as found in a Venetian blind, which requires oppositely moving suspension cords, the opening member 114 is raised to provide sufficient force to overcome the weight of the distal portion 107 and distal portion 105 of the row 101. Assisting in the pivotal rotation is the weight 122, which assists in counterbalancing the greater weight of the distal portion 107. As shown, when tilted, the relatively flat profile of the rows enables most of the area of the window covering to be opened to let light through.

Figure 8:
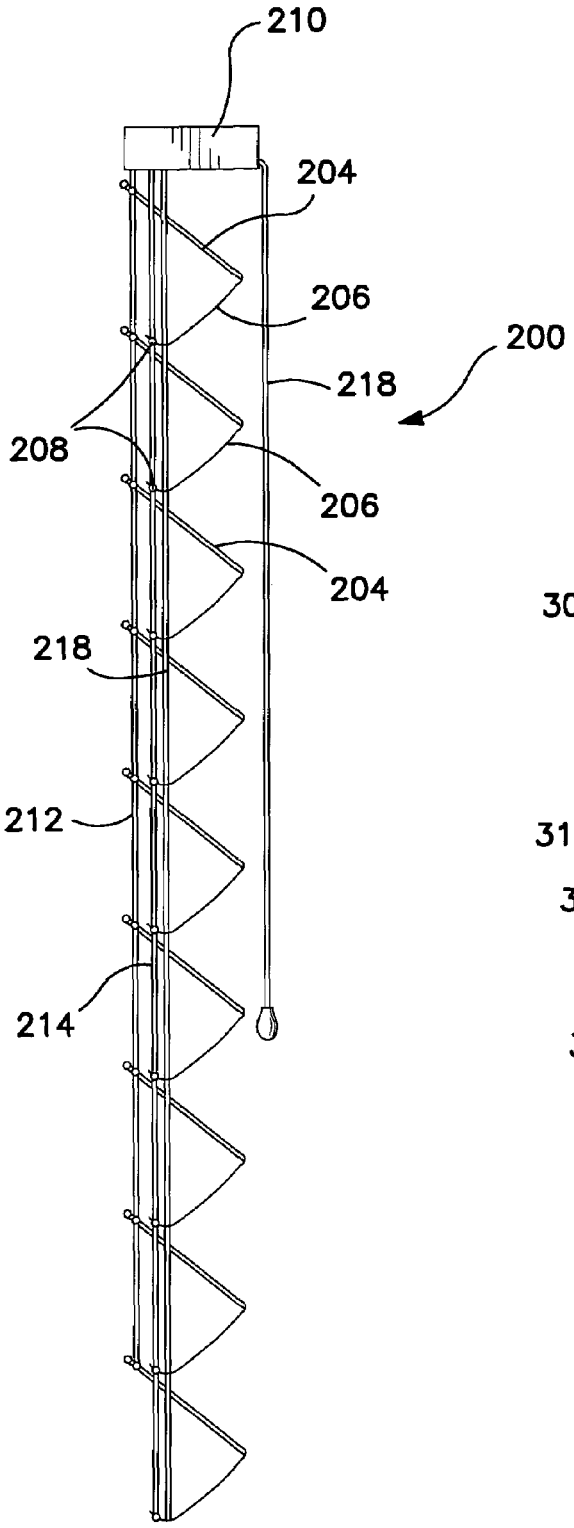
FIG. 8 is an elevated side view of an alternate embodiment of a window covering according to the present invention in a closed state and having stiffened second transverse regions.

In the embodiments discussed thus far, the second transverse region of the rows has been described as formed of a flexible material, such as fabric, so that it hangs freely or drapes. In the alternative, the second transverse region may be stiffened or contoured to provide other desired aesthetic appearances. For example, an embodiment of the present invention wherein the second transverse region is stiffened as shown in FIG. 8. As in the previous embodiment, window covering 200 includes a head rail 210, a securement member 212, an opening member 214, and a raising cord 218.

In this embodiment, the window covering 200 includes a second transverse region 206 that is stiffened similar to the first transverse region 204. As such, rather than have a draped appearance, a regular pleated appearance is provided. Preferably, the first transverse region 204 is of a slightly greater width than the second transverse region 206 so that when the stiffened edge portion 208 of the second transverse region 206 contacts the first transverse region 204, the first transverse region and the second transverse region are stacked substantially flat with one another. In a preferred embodiment, the second transverse region 206 and the first transverse region 204 are stiffened through incorporation of a stiffening member, such as a plastic strip.

Figure 9:
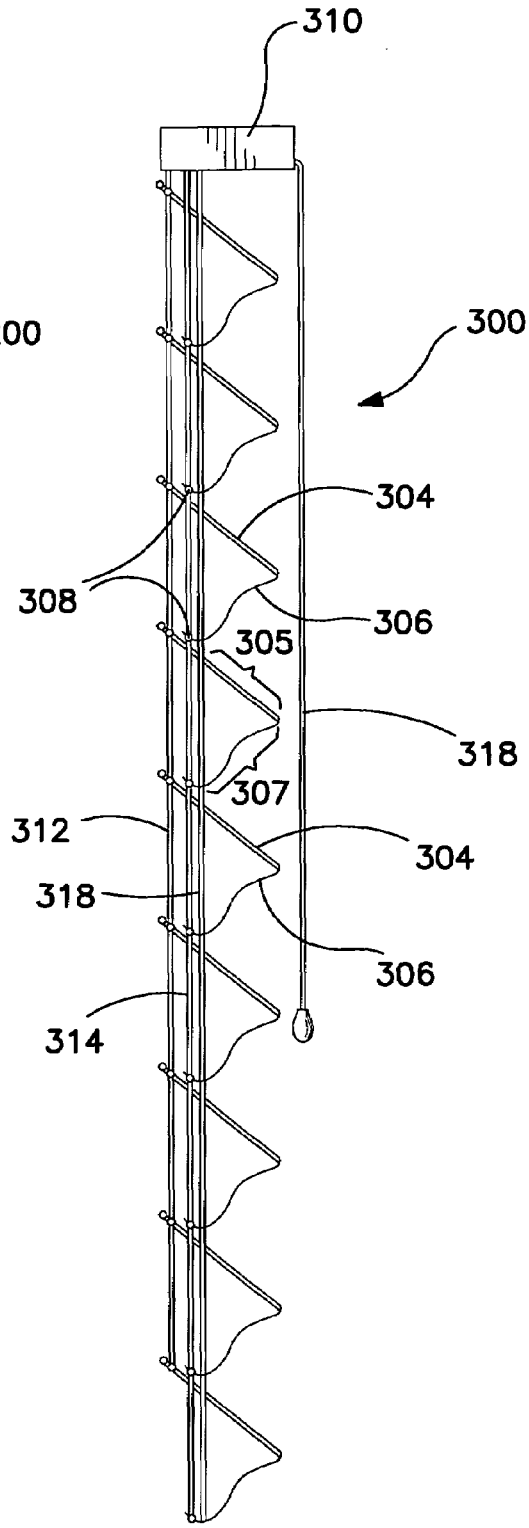
FIG. 9 is an elevated side view of yet another alternate embodiment of a window covering according to the present invention in a closed state and having contoured second transverse regions.

Yet another embodiment of a window covering 300 according to the present invention is shown in FIG. 9. Again, window covering 300 includes a head rail 310, a securement member 312, an opening member 314, and a raising cord 318. In this embodiment the second transverse region 306 is formed of a flexible fabric material. Second transverse region, while being flexible, is also contoured through particular weaving patterns or fabric treatment to hang in a desired shape. In other words, rather than freely hang or drape, the fabric maintains a particular shape in the closed state.

Similar to other embodiments described, the distal portion 305 of the first transverse region 304 is of substantially the same length as the distal portion 307 of the second transverse region 306 so that when the stiffened edge portion 308 of the second transverse region 306 contacts the first transverse region 304, thereby reaching the semi-opened stated, the distal portions 305 and 307 lie adjacent to one another and form a substantially flat profile. Further movement to the opened state is accomplished in the same manner as discussed above.

Figure 11:
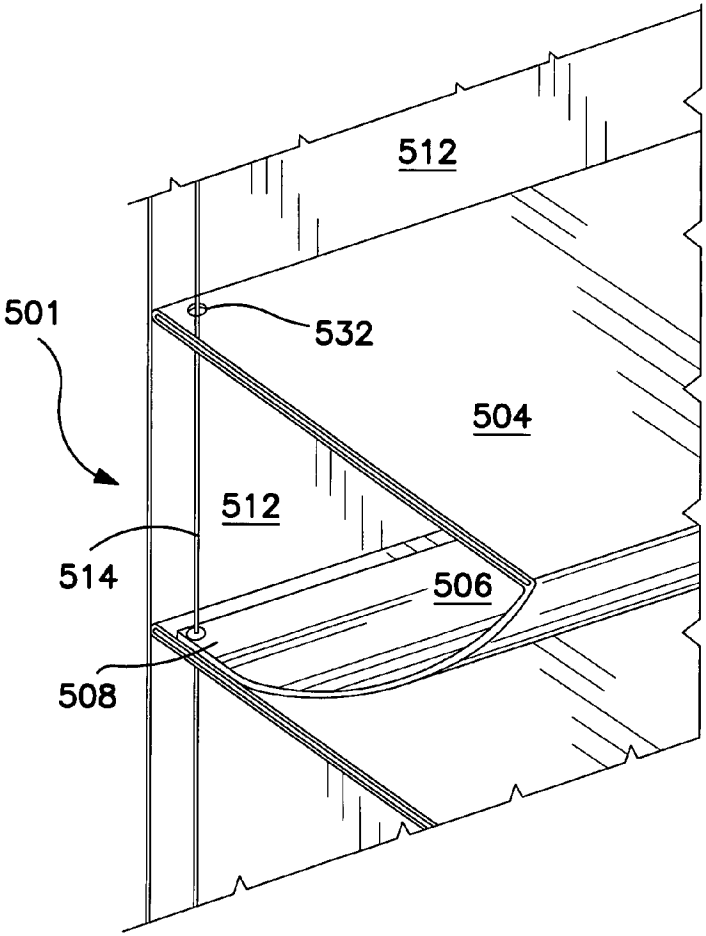
FIG. 11 is an enlarged perspective front view of another alternate embodiment of rows of a window covering according to the present invention utilizing a panel as part of the operating mechanism.
Figure 10:
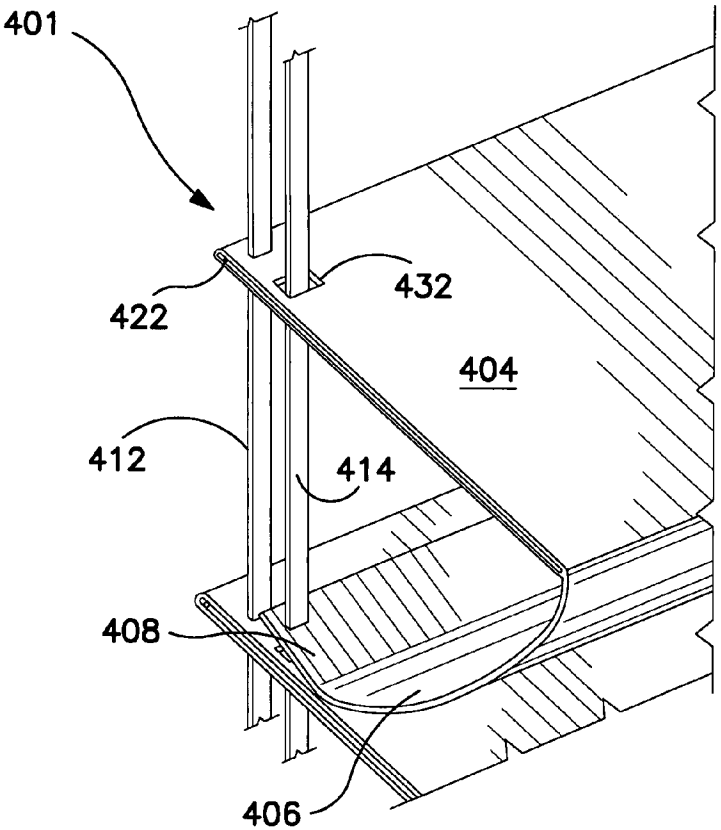
FIG. 10 is an enlarged perspective front view of another alternate embodiment of rows of a window covering according to the present invention and utilizing strips of material as part of the operating mechanism.

Two additional embodiments of window coverings according to the present invention are shown in FIGS. 10 and 11. In FIG. 10, the window covering is similar to that shown in FIG. 1. One difference, however, is that for each of the rows, such as row 401 securement member 412 and opening member 414 are formed of narrow strips of material. As shown, opening member 414 passes through a hole 432 formed in the first transverse region 404, and securement member 412 is secured to the first transverse region 404. Opening member 414 is then secured to the stiffened edge portion 408 of the second transverse region 406. As with the previous embodiments, a weight member 422 is also included.

In FIG. 11, the window covering comprising a plurality of rows, such as row 501, utilizes a panel 512 extending across the rear of the window covering 500 as the securement member. The panel 512 may be formed of any desired fabric, such as a translucent fabric that will permit light to penetrate yet still maintain privacy even when the plurality of rows 502 are opened. Opening member 514 comprises a cord that is passed through a hole 532 formed in the first transverse region 504, and is secured the stiffened edge portion 508 of the second transverse region 506.

Figure 12:
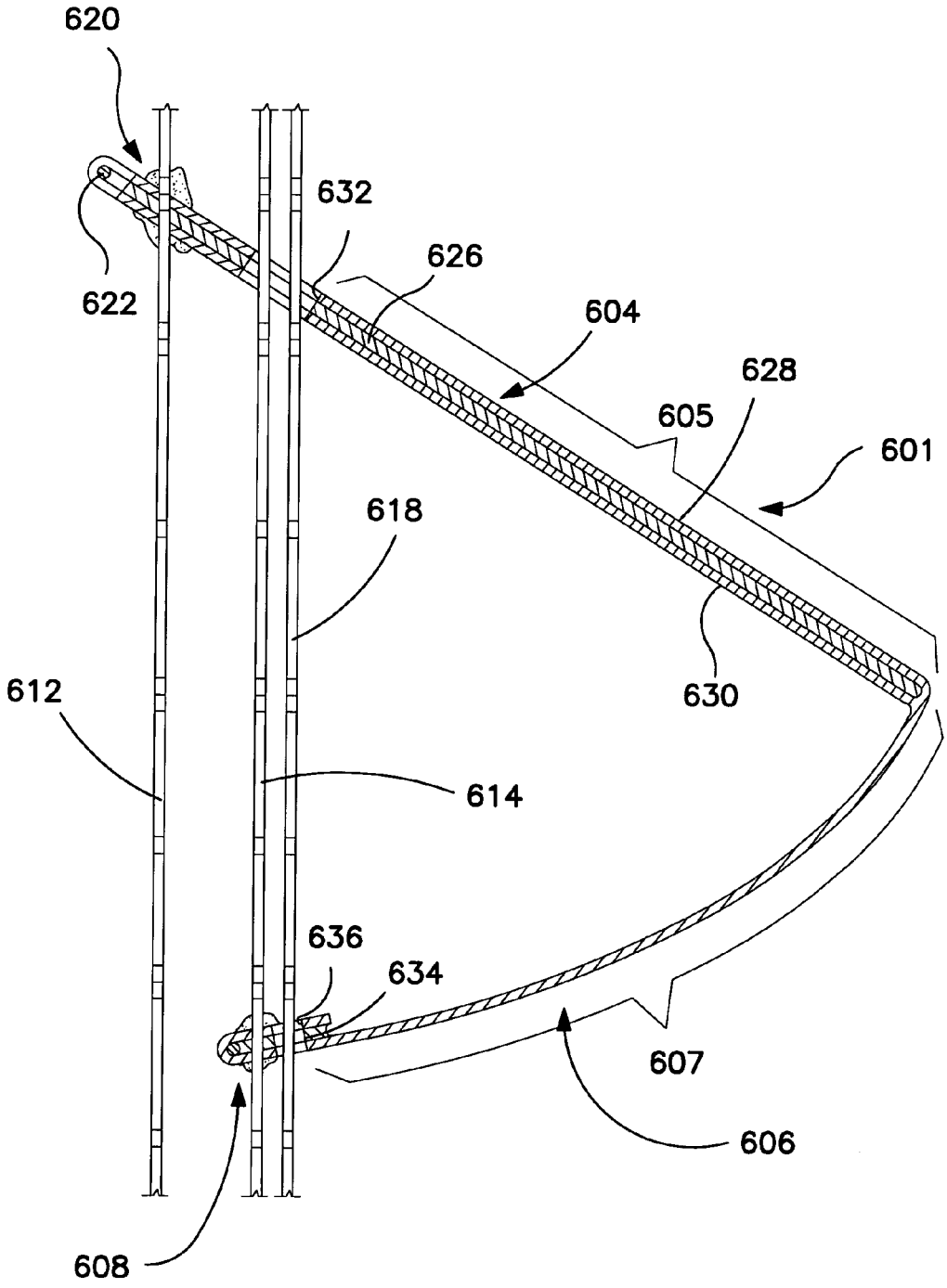
FIG. 12 is an enlarged cross sectional side view of a preferred row of another embodiment of a window covering in a closed state.

Another embodiment of a window covering according to the present invention is explained with reference to FIGS. 12–14.

In the embodiments discussed thus far, the narrowing and tilting of the various rows is achieved by raising a stiffened row edge portion relative opening member relative to a stiff first transverse region. As shown in FIGS. 12–14, the narrowing and tilting of the various rows of the window covering, such as row 601, is accomplished by lowering the stiff first transverse region 604 relative to the stiffened row edge portion 608. Each of the transverse regions 604 and 606 include a distal portion 605 and 607, respectively. The first transverse region 604 further defines a hole 632, and includes a stiffening member 626 sandwiched between two portions of fabric 628 and 630. Positioned with the first edge 620 of the first transverse region 604 is weight 622. Opening member 614 is secured to the first edge 620, whereas securement member 612 and raise cord 618 are passed through hole 632, and therefore not secured to the first transverse region 604. The second transverse region 606 includes a stiffened edge portion 608 and defines a hole 636, through which raise cord 618 is passed. Securement member 612 is secured to this stiffened edge portion 608. The opening member 614 passes rearward of the second transverse region 606. Preferably, the securement member 612 and raise cord 618 are connected to a bottom rail, such as shown in FIG. 1.

Figure 13:
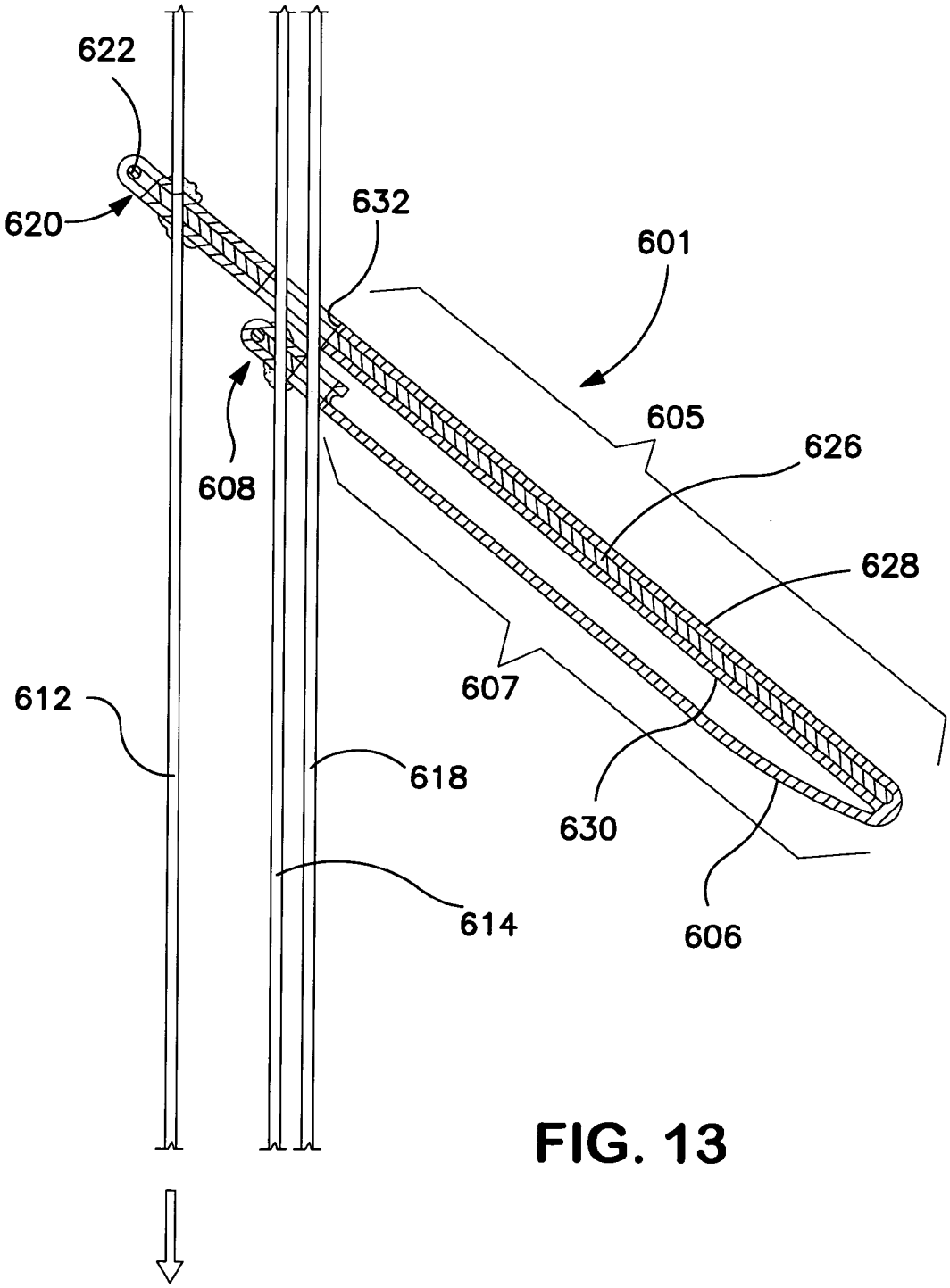
FIG. 13 is an enlarged cross sectional side view of the row of FIG. 12 in a semi-opened state.

As shown in FIG. 13, as the opening member 614 is lowered, the second distal portion 607 of the second transverse region 606 travels behind the first distal portion 605 of the first transverse region 604, thereby narrowing the profile of the row 601 and creating a gap between adjacent rows. The semi-opened state, as in previous embodiments, is reached when the stiffened edge portion 608 of the second transverse region 606 contacts the first transverse region 604.

Figure 14:
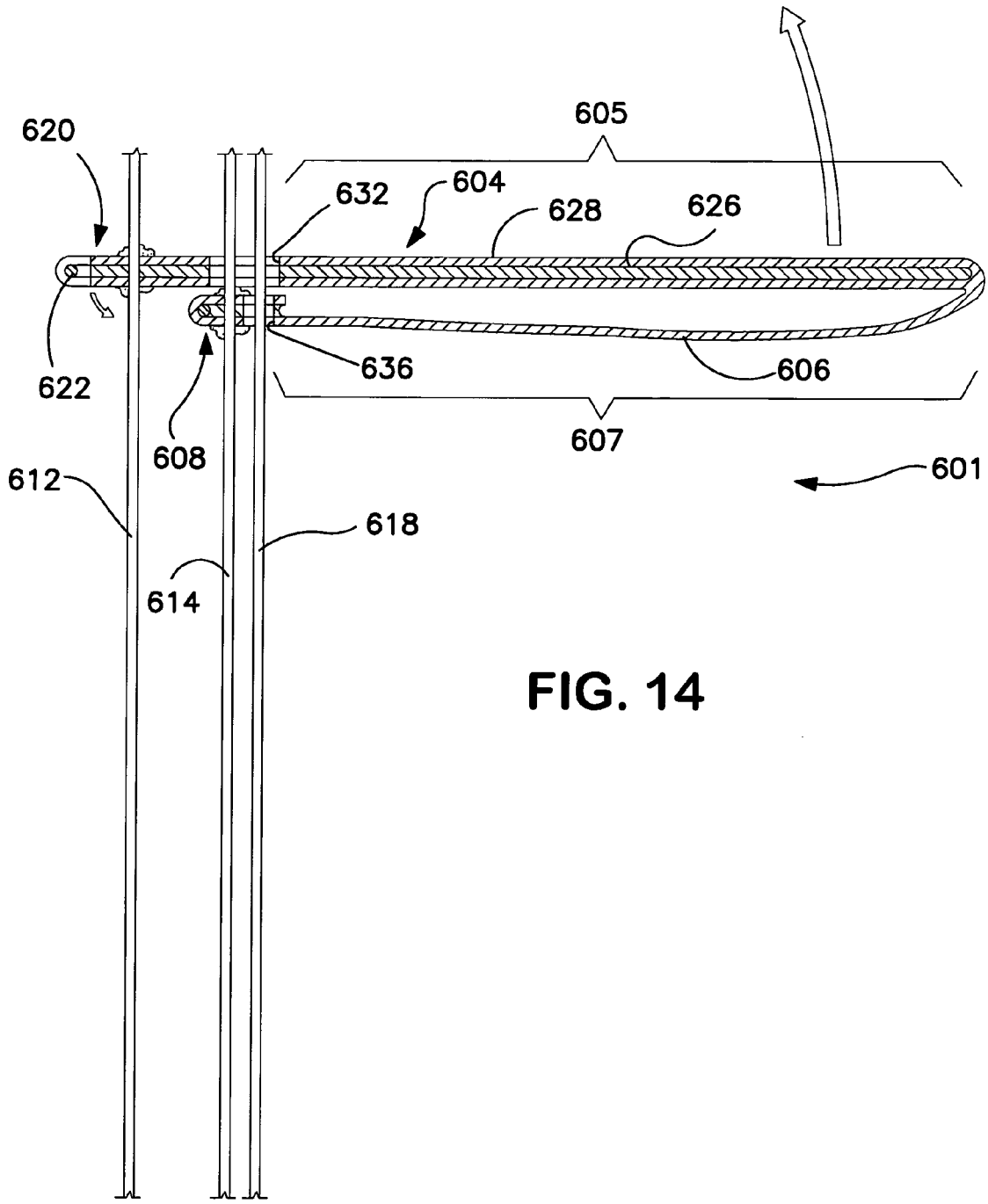
FIG. 14 is an enlarged cross sectional side view of the row of FIG. 12 in an opened state.

Referring to FIG. 14, as the opening member 614 is dropped even further, the first transverse region 604 is pivoted or rotated about the stiffened edge portion 608. Weight 622 also promotes the pivotal rotation by counterbalancing the greater weight of the distal portions 605 and 607.

Another optional feature of the window covering is the inclusion of fastener modules with each of the rows that permit a user to select the particular rows that are operatively connected to the operating mechanism. See for example, co-pending application entitled Fastener Module For a Window Covering and Method For Opening Selected Rows of the Window Covering, and listing as inventors Messrs. Fu-Lai Yu, Chin-Tien Huang, and Shun-Chi Yu, which is incorporated by reference. As such, only selected rows are moved from the closed state to the open state by actuating the operating mechanism.

The foregoing descriptions are to be taken as illustrative, but not limiting. Still other variants within the spirit and scope of the present invention will readily present themselves to those skilled in the art.

What is claimed is:

1. A window shade comprising:

a plurality of collapsible shade rows, adjustable from a closed state to an opened state;

each of the shade rows including a stiff first transverse region and an opposed second transverse region having a stiffened edge portion; and an operating mechanism secured with the stiff first transverse region and the second transverse region, wherein the operating mechanism is capable of controllably adjusting the plurality of collapsible shade rows by moving at least one of the rows from the closed state to the opened state by first moving the row from the closed state to a semi-opened state by narrowing the row, wherein the stiffened edge portion contacts the first transverse region, and subsequently moving the row from the semi-opened state to the opened state by pivoting the complete row.

2. The window shade of claim 1, wherein the first stiff transverse region of at least one of the shade rows is operatively connected with a weight to assist the shade row to pivotally rotate to the opened state.

3. The window shade of claim 1, wherein the operating mechanism includes an opening member and a securement member.

4. The window shade of claim 3, wherein the opening member is secured with the stiffened edge portion, and the securement member is secured with the first transverse region.

5. The window shade of claim 4, wherein the opening member is raised relative to the securement member to adjust the plurality of shade rows.

6. The window shade of claim 3, wherein the opening member is secured with the first transverse region and the securement member is secured with the stiffened edge portion.

7. The window shade of claim 6, wherein the opening member is lowered relative to the securement member to adjust the plurality of shade rows.

8. The window shade of claim 3, wherein the securement member is movable to adjust the plurality of rows.

9. The window shade of claim 3, wherein the securement member and the opening member are independently movable.

10. The window shade of claim 1, wherein the operating mechanism is concealed when the window covering is in a closed position.

11. The window shade of claim 1, wherein the operating mechanism comprises strips of material.

12. The window shade of claim 1, wherein the operating mechanism comprises cord members.

13. The window shade of claim 1, wherein the operating mechanism comprises a panel extending across the rear of the window shade.

14. The window shade of claim 1, wherein each of the plurality of shade rows has a substantially flat profile when in the semi-opened state.

15. The window shade of claim 1, wherein in the semi-opened state the stiffened edge portion of at least one shade row contacts the stiff first transverse region of the at least one shade row.

16. The window shade of claim 1, wherein the operating mechanism moves at least one of the rows from the closed state to the semi-opened state by narrowing the rows, and thereafter moves the rows from the semi-opened state to the opened state by pivoting the shade rows.

17. A window shade, comprising:

a plurality of collapsible shade rows; each row having opposing edge portions and an operating mechanism secured with a plurality of shade rows, wherein the operating mechanism is operable to fully collapse the plurality of rows from a closed state to a semi-opened state by narrowing the rows, wherein the opposing edge portions are in contact, and to separately and subsequently move the plurality of rows from the semi-opened state to an opened state by pivoting each of the fully collapsed rows.

18. The window shade of claim 17, wherein:

each of the shade rows includes a first stiff transverse region defining a first edge and an opposed second transverse region having a stiffened edge portion;

the operating mechanism is secured with the stiff first transverse region and the second transverse region; and the operating mechanism is suitable for narrowing the plurality of collapsible shade rows from the closed state to the semi-opened state by decreasing the distance between the first edge and the second stiffened edge portion.

19. The window shade of claim 18, wherein the first stiff transverse region of at least one of the plurality of shade rows is operatively connected with a weight to bias the shade row to pivotally rotate from the semi-opened state to the opened state in an opening direction.

20. The window shade of claim 18, wherein the operating mechanism includes an opening member secured with the stiffened edge portion, and a securement member secured with the first transverse region.

21. The window shade of claim 18, wherein the operating mechanism includes a securement member secured with the stiffened edge portion, and an opening member secured with the first transverse region.

22. The window shade of claim 16, wherein the operating mechanism comprises an opening member and a securement member, each of the opening member and the securement member are comprised of any of a cord or strip of material.

23. The window shade of claim 16, wherein the operating mechanism comprises a panel extending across the rear of the window covering.

24. The window shade of claim 16, wherein the second transverse region is comprised of a stiff material.

25. A method of opening a window shade comprising an operating mechanism and a plurality of collapsible shade rows, each row having opposing edge portions the window shade having a closed state, a semi-opened state and an opened state, the method comprising:

actuating the operating mechanism to adjust at least some of the plurality of shade rows from the closed state to the semi-opened state by fully collapsing the at least some of the plurality of shade rows; wherein the opposing edge portions are in contact; and further actuating the operating mechanism thereafter to further move the plurality of shade rows from the semi-opened state to the opened state by pivotally rotating each of the plurality of fully collapsed shade rows.

26. The method of claim 25, wherein each of the plurality of shade rows has a substantially flat profile when in the opened state.

27. The method of claim 25, wherein each of the shade rows includes a stiff first transverse region and an opposed second transverse region having a stiffened edge portion, and wherein the narrowing of the plurality of shade rows from the closed state to the semi-opened state comprises decreasing the distance between the first transverse region and the stiffened edge portion.

28. The method of claim 25, wherein each of the shade rows includes a stiff first transverse region defining a first edge and an opposed second transverse region having a stiffened edge portion, and wherein the pivotal rotation of each of the plurality of shade rows from the semi-opened state to the opened state comprises adjusting the relative positions of the stiffened edge portion and the first edge.

29. A window covering comprising a plurality of shade rows and an operating mechanism operatively connectable with each of the plurality of shade rows, each of the shade rows comprising:

a first longitudinal region comprising a first distal portion and a first edge portion, the first longitudinal region securable with the operating mechanism at the first edge portion, the first distal region further being stiffened;

a second longitudinal region comprising a second distal portion and a stiffened edge portion, the second longitudinal region securable with the operating mechanism at the stiffened edge portion; and the second distal portion being at least of substantially equal length to the first distal portion;

the operating mechanism comprising an opening member and a securement member, and capable of narrowing at least one of the plurality of shade rows from a closed state to a semi-opened state by moving the stiffened edge portion and the first longitudinal region into contact with one another; and the operating mechanism further capable of subsequently pivoting at least one of the plurality of shade rows from the semi-opened position to an opened position.

30. The window covering of claim 29, wherein the first longitudinal region of the shade row is operatively connected with a weight to bias the shade row to pivotally rotate from the semi-opened state to the opened state in an opening direction.

31. The window covering of claim 29, wherein the opening member is secured with the stiffened edge portion, and the securement member secured with the first transverse region.

32. The window covering of claim 29, wherein the securement member is secured with the stiffened edge portion, and the opening member is secured with the first transverse region.

33. The window covering of claim 29, wherein the operating mechanism comprises any of an opening cord, strip of material, or a panel extending across the rear of the window covering.

34. The window covering of claim 29, wherein the opening member and the securement member are capable of independent movement.

35. The Window covering of claim 29, wherein the second distal portion is of a greater length than the first distal portion.

36. A window shade comprising:

a plurality of collapsible shade rows, each of the shade rows including a stiff first transverse region and an opposed second transverse region having a stiffened edge portion; and an operating mechanism secured with the stiff first transverse region and the second transverse region, wherein the operating mechanism is operable to turn at least one shade row from an expanded state by bringing the first transverse region and stiff edge portion into contact with each other to a narrowed state to create a gap between the at least one shade row and an adjacent shade row, and the operating mechanism is also operable to pivot the shade row in the narrowed state.

37. The window shade of claim 36, wherein the stiff first transverse region of at least one shade row is operatively connected with a weight to assist the at least one shade row to pivotally rotate in the narrowed state.

38. The window shade of claim 36, wherein the operating mechanism includes an opening member and a securement member.

39. The window shade of claim 38, wherein the opening member is secured with the stiffened edge portion, and the securement member is secured with the first transverse region.

40. The window shade of claim 39, wherein the opening member is raised relative to the securement member to adjust the plurality of shade rows.

41. The window shade of claim 38, wherein the opening member is secured with the first transverse region and the securement member is secured with the stiffened edge portion.

42. The window shade of claim 41, wherein the opening member is lowered relative to the securement member to adjust the plurality of shade rows.

43. The window shade of claim 38, wherein the securement member is movable to adjust the plurality of rows.

44. The window shade of claim 38, wherein the securement member and the opening member are independently movable.

45. The window shade of claim 36, wherein the operating mechanism is concealed when the window covering is in a closed position.

46. The window shade of claim 36, wherein the operating mechanism comprises strips of material.

47. The window shade of claim 36, wherein the operating mechanism comprises cord members.

48. The window shade of claim 36, wherein the operating mechanism comprises a panel extending across the rear of the window shade.

49. The window shade of claim 36, wherein each of the plurality of shade rows has a substantially flat profile when in the semi-opened state.

50. The window shade of claim 36, wherein in the semi-opened state the stiffened edge portion of at least one shade row contacts the stiff first transverse region of the at least one shade row.

* * * * *